US005583492A

United States Patent [19]

Nakanishi et al.

[11] Patent Number: 5,583,492

[45] Date of Patent: Dec. 10, 1996

[54] METHOD AND APPARATUS FOR MONITORING INSIDE A MANHOLE

[75] Inventors: Yutaka Nakanishi; Shinichi Nakagawa; Yoshiaki Nakatsuru, all of Osaka; Yasuyuki Hishida, Ibaraki; Ryoji Matsubara, Ibaraki; Kimiharu Kanemaru, Ibaraki, all of Japan

[73] Assignees: Hitachi Cable, Ltd., Tokyo; The Kansai Electric Power Co., Inc., Osaka-fu, both of Japan

[21] Appl. No.: 310,678

[22] Filed: Sep. 22, 1994

[30] Foreign Application Priority Data

Sep. 24, 1993 [JP] Japan ..... 5-237845
Feb. 17, 1994 [JP] Japan ..... 6-020322

[51] Int. Cl.[6] ..... G08B 23/00

[52] U.S. Cl. ..... 340/870.02; 340/870.01; 340/870.31; 343/719

[58] Field of Search ..... 340/870.3, 870.31, 340/870.02, 870.01; 343/719, 720, 845; 73/592

[56] References Cited

U.S. PATENT DOCUMENTS 4,098,117 7/1978 Baumoel ..... 73/194
4,205,315 5/1980 Fleenor ..... 343/720
4,687,445 8/1987 Williams ..... 343/719
5,041,827 8/1991 Kirstein ..... 340/870.3
5,298,894 3/1994 Cerny ..... 343/719
5,371,496 12/1994 Tanamachi ..... 340/870.3

*Primary Examiner*—Jeffery Hofsass
*Assistant Examiner*—Albert K. Wong
*Attorney, Agent, or Firm*—Helfgott & Karas, P.C.

[57] ABSTRACT

Maintenance information is collected by a sensor on an electric power cable installed in a manhole. The information is transmitted to a radio transmitter which is positioned in a vicinity of a bottom plane of an inner lid in an opening of the manhole. The information is transmitted by the radio transmitter, and received by a receiving antenna mounted on a bottom plane of the inner lid. On a top plane of the inner lid, an electrode, a connecting lead or a transmitting antenna is provided to be connected to the receiving antenna by an impedance matching circuit. The information is supplied to an outer lid in the opening of the manhole by the opening of the manhole by the electrode using a spatial coupling capacitance relative to the outer lid, or the connecting lead directly connected to the outer lid. Thus, the information is transmitted as a radio signal by the outer lid functioning as an antenna. Otherwise, the information is radiated below the outer lid by the transmitting antenna. Thus, the radiated information is leaked via the outer lid to the exterior of the manhole.

16 Claims, 6 Drawing Sheets

METHOD AND APPARATUS FOR MONITORING INSIDE A MANHOLE

FIELD OF THE INVENTION

The invention relates to a method and an apparatus for monitoring the inside of a manhole (splicing chamber), and more particularly, to a method and an apparatus for collecting information of maintaining electric and communication cables, etc. in a manhole and transmitting the information from the inside of the manhole to a portable receiver or a receiver in a station positioned on the ground.

BACKGROUND OF THE INVENTION

Electric power cable lines are indispensable equipments to supply electric power energies to customers or subscribers, and the fault or damage of the equipments will result in significantly bad influence in the highly electrified societies. In the worst case, the functions of the societies will be paralyzed in almost all fields.

Therefore, it is the most important task that underground electric power lines installed in conduit or duct lines are well maintained and administrated to provide the stabilized state in the equipments. For this purpose, the inside of a manhole for installing and/or splicing electric power cables must be monitored.

In addition to underground electric power cable manholes, other manholes for gas supply pipes, water supply pipes, communication cable lines, etc. are required to be maintained and administrated for stabilized supply services of gas, water, communication, etc.

Conventional maintenance and administration in a manhole are carried out in a manner that a maintenance operator goes inside the manhole periodically or at the time of inspection of cables, etc. In such a case, following extremely troublesome operation and procedure are required.

(1) An application of obtaining an approval of operation on a road is required, because an opening of a manhole is mainly positioned on the road.

(2) A safety fence for an operator in operation on a road, a sign for indication of operation, an operator for control of traffics, an operator for safety-inspection of operation, etc. are required to be arranged.

(3) Auxiliary operation such as opening a lid, draining water, measuring a content of oxygen, etc. is required prior to entering a manhole.

(4) During operation, the measurement of oxygen content must be continued, and the ventilation of a manhole is kept to be carried by a blower.

In order to obviate such troublesome operation and procedure, some proposals have been explained in the Japanese Utility Model Kokai No. 3-44647, in which the first proposal is that an antenna is installed in a manhole closed by a lid to transmit a radio signal of, for instance, a bomb pressure via a key hole of the lid to a receiver position on the ground, the second proposal is that a lid for closing an opening of a manhole is used for an antenna, and the third proposal is that an antenna is protruded over a closed lid of a manhole.

However, the above proposals have disadvantages in that information of a manhole obtained on the ground is not precise, because an electric field strength of a radiated radio signal is weak, when some obstructing members of electric waves exist in the manhole. Especially, when a manhole has a double lid structure of outer and inner lids, electric waves are shielded by the inner lid. Consequently, information about equipment in the manhole is not obtained on the ground.

Accordingly, it is an object of the invention to provide a method and an apparatus for monitoring an inside of a manhole, in which no operator is required to go into the interior of a manhole.

It is a second object of the invention to provide a method and an apparatus for monitoring an inside of a manhole in which a radiated radio signal of a predetermined electric field strength is obtained on the ground.

SUMMARY OF THE INVENTION

According to a first aspect of the invention, a method for monitoring an inside of a manhole comprises the steps of:

collecting information in the manhole;

transmitting the information to a radio transmitter, the radio transmitter being positioned in a vicinity of a bottom surface of an inner lid positioned in an opening of the manhole;

transmitting the information as a radio signal from the radio transmitter to a receiving antenna provided on the bottom surface of the inner lid;

coupling the information from the receiving antenna to an outer lid positioned in the opening of the manhole; and transmitting the information as a radio signal from the outer lid to an exterior of the manhole.

According to a second aspect of the invention, a method for monitoring an inside of a manhole comprises the steps of:

collecting information in the manhole;

transmitting the information to a radio transmitter, the radio transmitter being positioned in a vicinity of a bottom surface of an inner lid positioned in an opening of the manhole;

transmitting the information as a radio signal from the radio transmitter to a receiving antenna provided on the bottom surface of the inner lid;

supplying the information to a transmitting antenna provided on a top surface of the inner lid, the transmitting antenna being matched in impedance with the receiving antenna; and transmitting the information as radio signal from the transmitting antenna to a space below an outer lid positioned in the opening of the manhole, the information being leaked through the outer lid to an exterior of the manhole.

According to a third aspect of the invention, an apparatus for monitoring an inside of a manhole comprises:

a sensor for collecting information in the manhole;

a signal processing circuit for processing the information to generate processed information;

a radio transmitter for transmitting the processed information, the radio transmitter being positioned in a vicinity of a bottom surface of an inner lid positioned in an opening of the manhole;

a receiving antenna for receiving the processed information transmitted from the radio transmitter, the receiving antenna being provided on the bottom surface of the inner lid;

a coupling member for coupling the processed information received from the receiving antenna to an outer lid positioned in the opening of the manhole, the coupling member being provided on a top surface of the inner lid and the processed information being transmitted as a radio signal from the outer lid to an exterior of the manhole.

According to a fourth aspect of the invention, an apparatus for monitoring an inside of a manhole comprises:

a sensor collecting information in the manhole;

a signal processing circuit for processing the information to generate processed information;

a radio transmitter for transmitting the processed information, the radio transmitter being positioned in a vicinity of a bottom surface of an inner lid positioned in an opening of the manhole;

a receiving antenna for receiving the processed information transmitted from the radio transmitter, the receiving antenna being provided on the bottom surface of the inner lid; and a transmitting antenna for transmitting the processed information as a radio signal into a space below an outer lid positioned in the opening of the manhole, the transmitting antenna being provided on a top surface of the inner lid, and the processed information being leaked through the outer lid to be radiated to an exterior of the manhole.

BRIEF DESCRIPTION OF THE DRAWINGS

The invention will be explained in more detail in conjunction with appended drawings, wherein.

DESCRIPTION OF THE PREFERRED EMBODIMENTS

Figure 1:
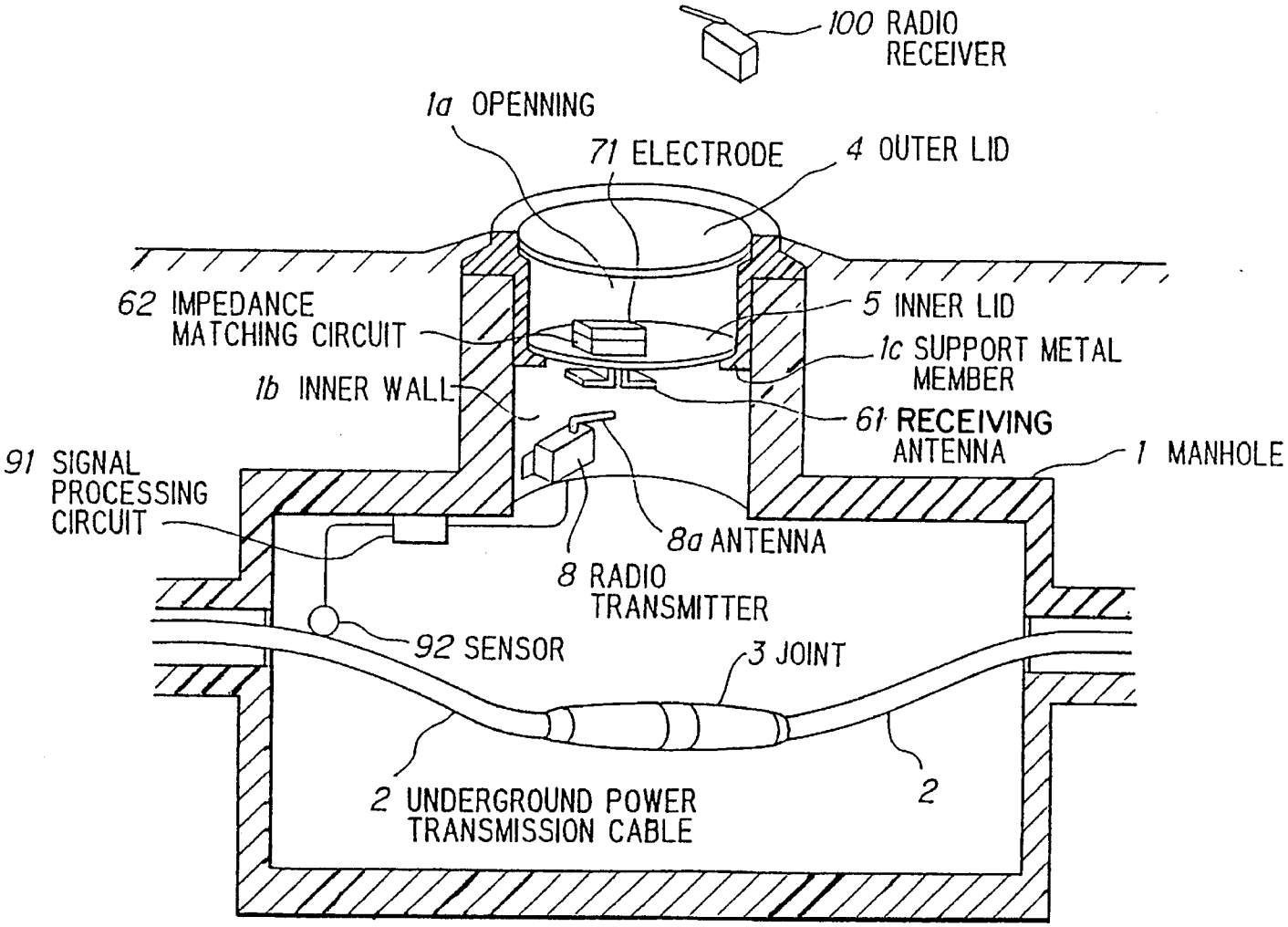
FIG. 1 is a schematic perspective cross-sectional view showing a first preferred embodiment according to the invention.

FIG. 1 shows an apparatus for monitoring the inside of a manhole in the first preferred embodiment according to the invention.

In FIG. 1, underground power transmission cables (electric power cables) 2 are installed to be connected at a joint 3 in a manhole 1 which is closed at an opening 1*a* by a double lid structure comprising an outer lid 4 having an outer diameter of approximately 700 to 900 mm and an inner lid 5 for avoiding water immersion of the manhole 1, wherein a distance between the outer and inner lids 4 and 5 is generally 200 to 300 mm.

A sensor 92 for collecting maintenance information of the power transmission cables 2 is provided thereon to be connected to a signal processing circuit 91, and a radio transmitter 8 with a transmitting antenna 8*a* of a small power type (less than 0.01 W in an antenna power) specified by the Electric wave act (Government regulations) is connected to the signal processing circuit 91, wherein the antenna 8*a* may be a widely used rod antenna. The signal processing circuit 91 and the radio transmitter 8 are fixed on an inner wall 1*b* of the manhole 1, and the sensor 92 may comprise a plurality of sensors for measuring various physical amounts for maintenance information.

A receiving antenna 61 which is, for instance, structured by a dipole antenna is provided on a bottom plane or surface of the inner lid 5 to receive a radio signal transmitted by the antenna 8*a*, and is preferable to be parallel in direction with the antenna 8*a*. On the other hand, an impedance matching circuit 62 is provided at the inner lid 5, to be connected at an input terminal to the receiving antenna 61, so that the antenna 61 and the outer lid 4 are matched in impedance. On the impedance matching circuit 62, an electrode 71 of copper or its alloy such as brass, etc. connected to an output terminal thereof and having a predetermined size and a predetermined surface area, is provided to provide a predetermined capacitance relative to the outer lid 4.

Figure 2:
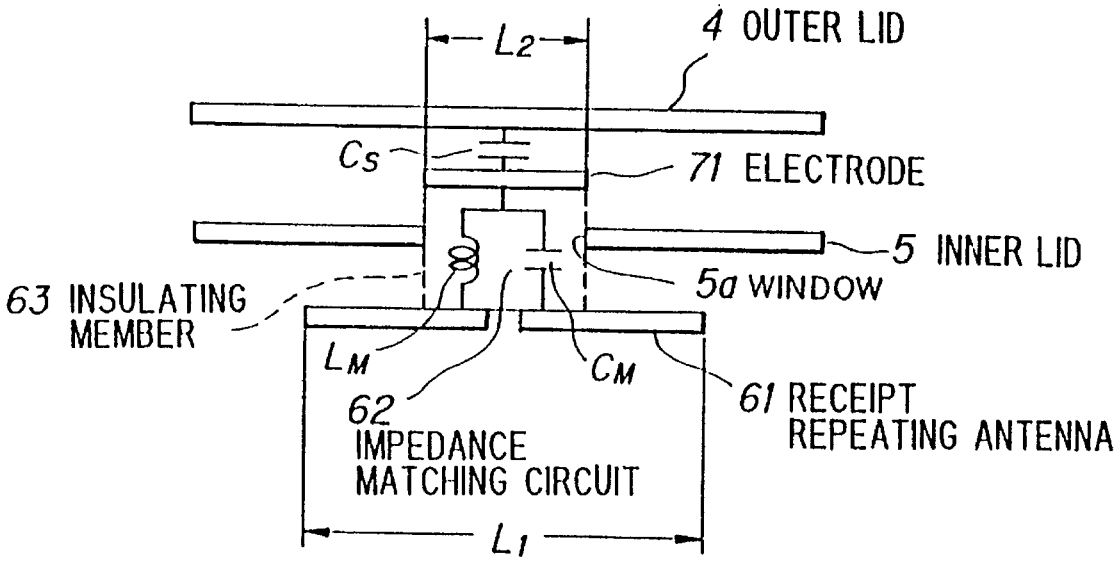
FIG. 2 is an explanatory diagram showing a double lid structure in the first preferred embodiment.

FIG. 2 shows the double lid structure as explained in FIG. 1, wherein like parts are indicated by like reference numerals.

In FIG. 2, the receiving antenna 61 consists of two metal plates of, for instance, copper or its alloy such as brass, etc., and a length $L_1$ of a signal receiving plane is set to be a half wavelength of a radio signal, for instance, approximately 350 mm. The impedance matching circuit 62 comprises a capacitance $C_M$ and an inductance $L_M$ which are contained in an insulating member 63 for fixing the repeating antenna 61. The insulating member 63 is fixed in a window 5*a* of the inner lid 5, wherein an upper half portion of the insulating member 63 is protruded above the inner lid 5, and a lower half portion thereof is protruded below the inner lid 5.

As described before, the receiving antenna 61 is connected to the input terminal of the impedance matching circuit 62, while the electrode 71 having a spatial coupling capacitance $C_S$ relative to the outer lid 4 is connected to the output terminal of the impedance matching circuit 62. In the first preferred embodiment, a length $L_2$ of the electrode 71 is approximately 175 mm. The outer lid 4 coupled to the electrode 71 by the capacitance $C_S$ functions as a transmitting antenna.

In this preferred embodiment, a transmission apparatus for transmitting maintenance information of the manhole 1 from the interior of the manhole 1 to a receiver positioned on ground is composed of the radio transmitter 8, the receiving antenna 61, the impedance matching circuit 62, the electrode 71, and the outer lid 4.

In operation, the maintenance information collected by the sensor 92 is supplied via the signal processing circuit 91 to the radio transmitter 8, from the antenna 8*a* of which a radio signal is transmitted. Thus, a transmitting electric power of the radio signal is received by the receiving antenna 61, so that the receiving antenna 61 supplies the maximum electric power via the impedance matching circuit 62, the electrode 71 connected thereto, and the spatial coupling capacitance $C_S$ to the outer lid 4. Consequently, the radio signal is transmitted to the exterior of the manhole 1 by the outer lid 4 functioning as an antenna, so that the radio signal is received by a radio receiver 100 which is one of a portable receiver carried by an operator in operation or a receiver in a fixed receiving station. If the radio signal is amplified in the receiving antenna 61 to the approximately maximum extent limited by the Electric wave act (Japanese Government Regulations), the radio signal is precisely received by the radio receiver 100 which is on the ground.

In the first preferred embodiment, the inner lid 5 is freely opened and closed together with the receiving antenna 61 and the impedance matching circuit 62 fixed thereto, because the receiving antenna 61 and the impedance matching circuit 62 have no leads connected to a fixed point.

Figure 3:
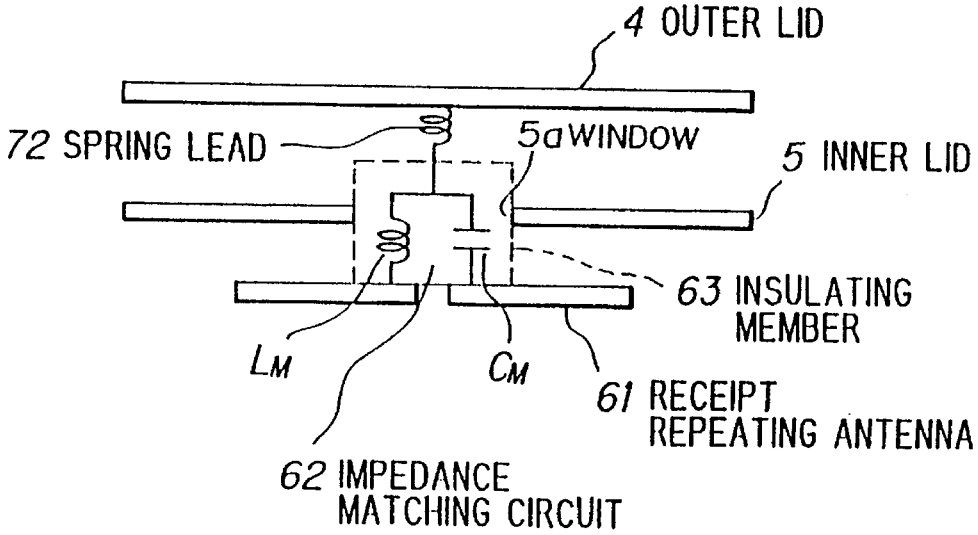
FIG. 3 is an explanatory diagram showing a modification of the double lid structure in the first preferred embodiment.

In the first preferred embodiment, the double lid structure may be modified as shown in FIG. 3, wherein like parts are indicated by like reference numerals.

In FIG. 3, the impedance matching circuit 62 is connected at the output terminal to a spring lead 72 having an end freely contacting with the bottom surface of the outer lid 4. In this structure, the impedance matching circuit 62 is electrically connected to the outer lid 4 in a more stable manner than in the structure using the spatial coupling capacitance $C_S$ of FIG. 2.

Figure 4:
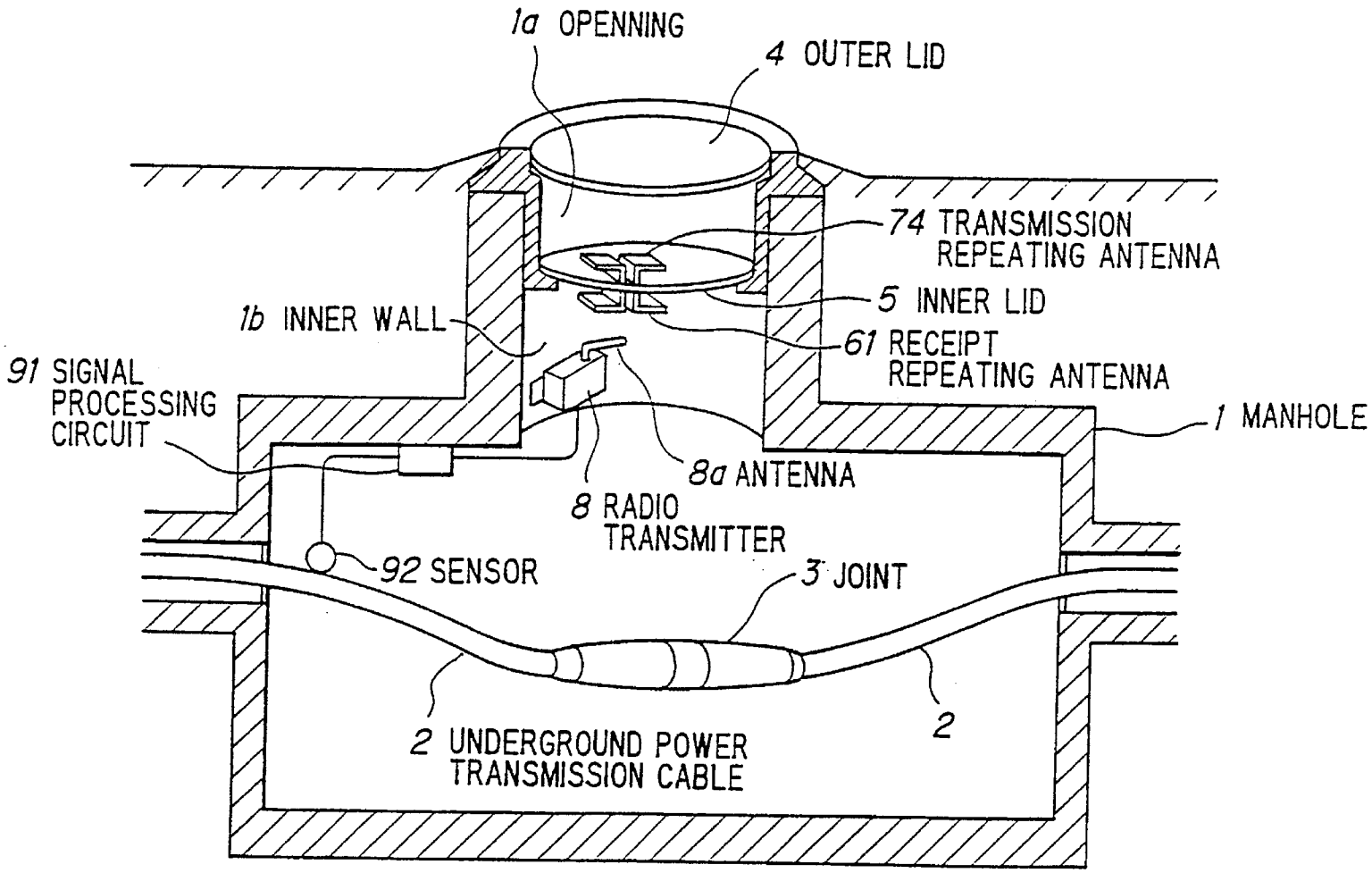
FIG. 4 is a schematic perspective cross-sectional view showing a second preferred embodiment according to the invention.

FIG. 4 shows an apparatus for monitoring an inside of a manhole of the second preferred embodiment according to the invention, wherein like parts are indicated by like reference numerals of the previously described figures.

In FIG. 4, a transmission repeating antenna 74 is provided on the top surface of the inner lid 5 to be connected via an impedance matching circuit (not shown, but the same as that in FIGS. 1 to 3) to a receipt repeating or receiving antenna 61 which is the same as that in FIGS. 1 to 3.

Figure 5:
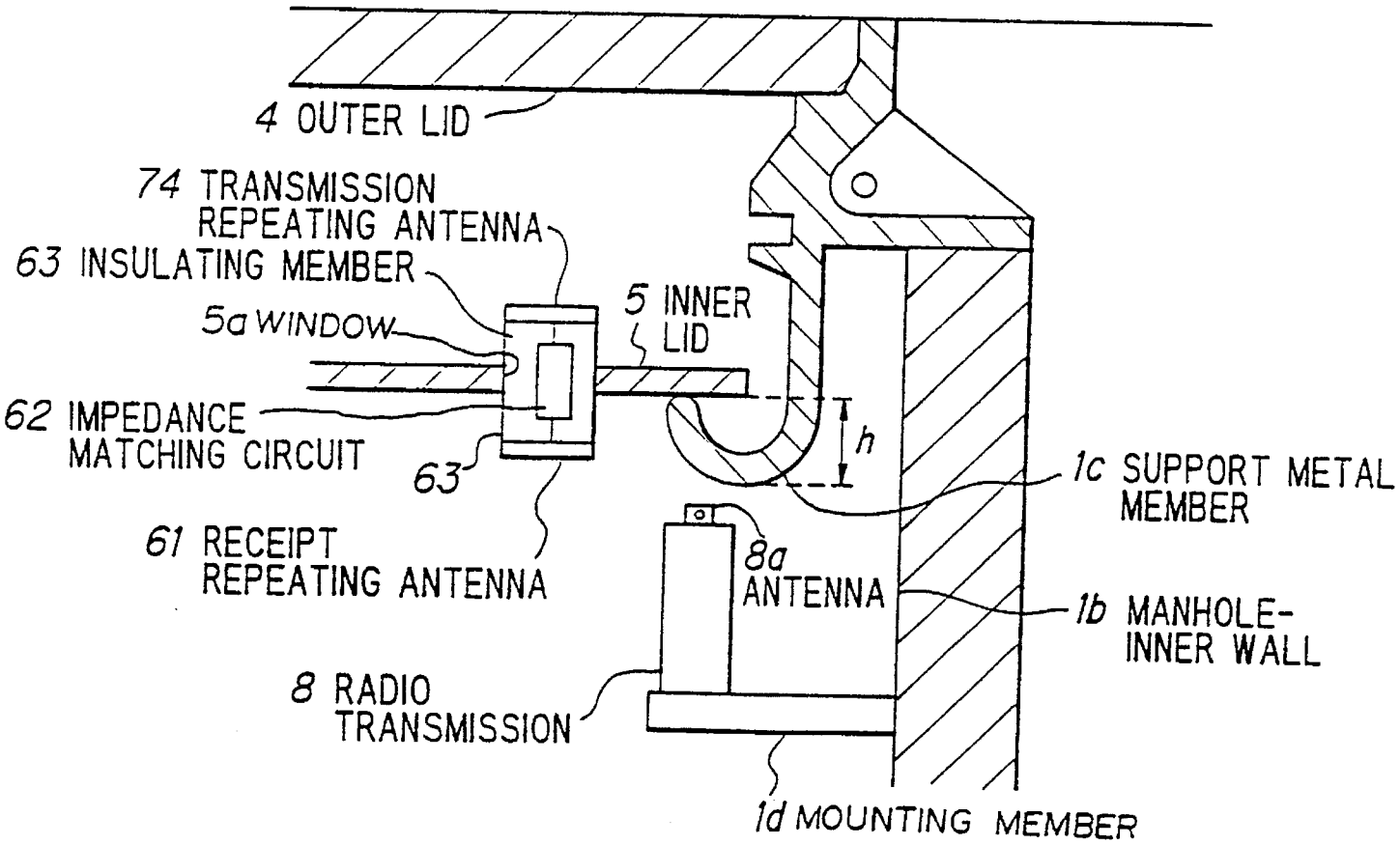
FIG. 5 is an explanatory diagram showing a double lid structure in the second preferred embodiment.

FIG. 5 shows the double lid structure used in the second preferred embodiment as shown in FIG. 4.

In FIG. 5, the inner lid 5 is provided on a support metal member 1*c* fixed on an inner wall 1*b* of the manhole 1, such that no gap exists between the inner lid 5 and the support metal member 1*c*, while the radio transmitter 8 is fixed on a mounting member 1*d* fixed to the inner wall, such that the radio transmitter 8 is not positioned inside a line vertical to a point of the inner edge of the support metal member 1*c*.

The inner lid 5 is apertured with the window 5*a* into which the impedance matching circuit 62 contained in the insulating member 63 is incorporated. On the bottom surface of the inner lid 5, the receipt repeating or receiving antenna 61 is fixed by the insulating member 63, and, on the top surface thereof, the transmission repeating antenna 74 is fixed by the insulating member 63.

In operation, the radio signal transmitted by the antenna 8*a* of the radio transmitter 8 is received by the receiving antenna 61 to be supplied via the impedance matching circuit 62 to the transmission repeating antenna 74, from which the radio signal is transmitted to be leaked through the outer lid 4 to the exterior of the manhole 1. Thus, the leaked radio signal is received by a receiver positioned on the ground.

In order to determine a transmission condition under which the radio signal is effectively leaked, dependent on a relation between a distance from the radio transmitter 8 to the inner lid 5 and an electric field strength at a point having a predetermined distance from the manhole 1, the experiments described below have been carried out.

1. The first experiment

Apparatus No. 1 to No. 3 are prepared as set out below.

(1) Apparatus No.1

The same as shown in FIGS. 4 and 5.

(2) Apparatus No.2

The inner lid 5 has no repeating antenna and no gap relative to the support metal member 1*c*.

(3) Apparatus No. 3

The inner lid 5 has no repeating antenna, but a gap relative to the support metal member 1*c*.

Figure 6:
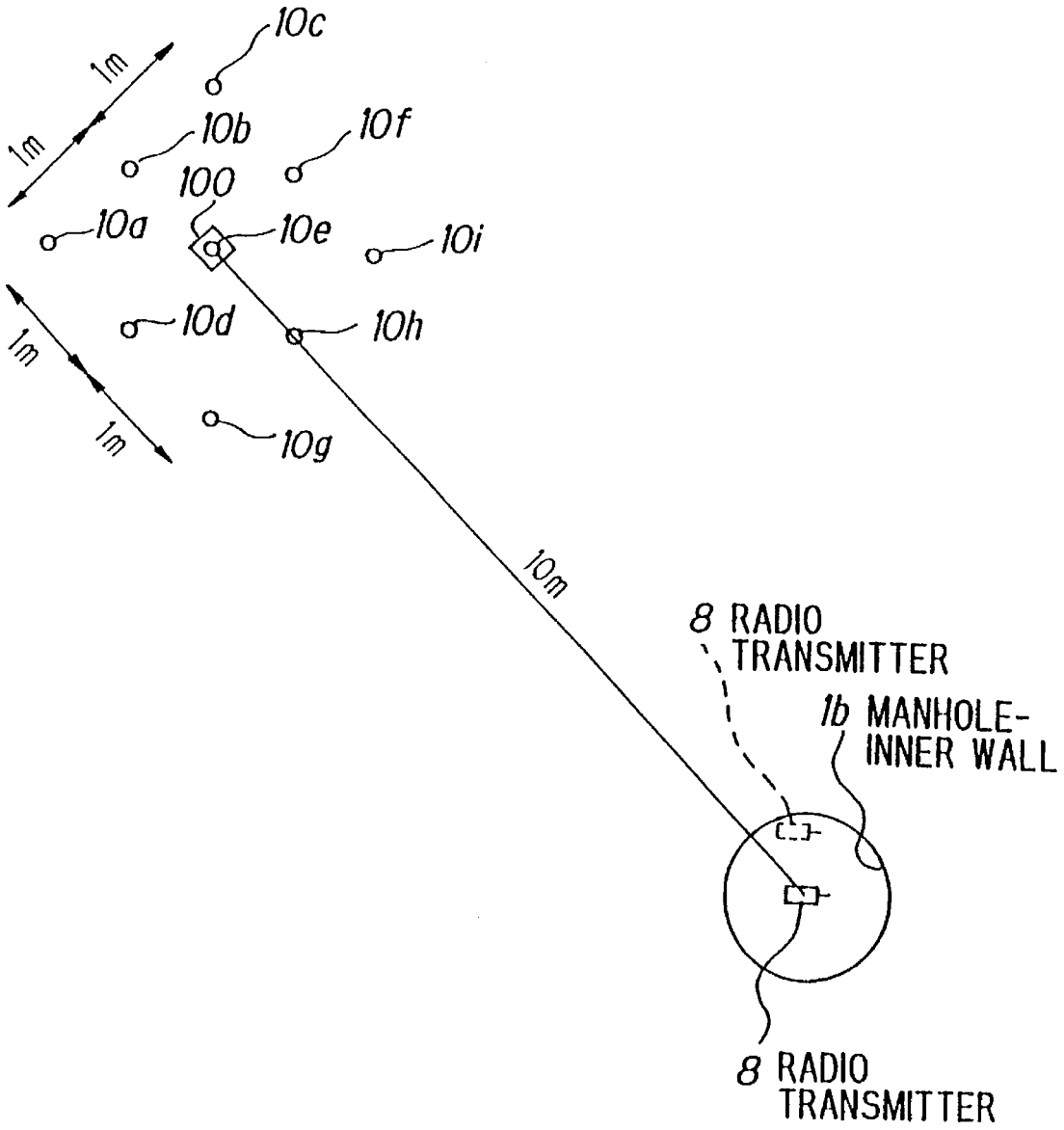
FIG. 6 is an explanatory diagram showing points at which an electric field strength is measured, when the height of a transmitter is changed.
Figure 7:
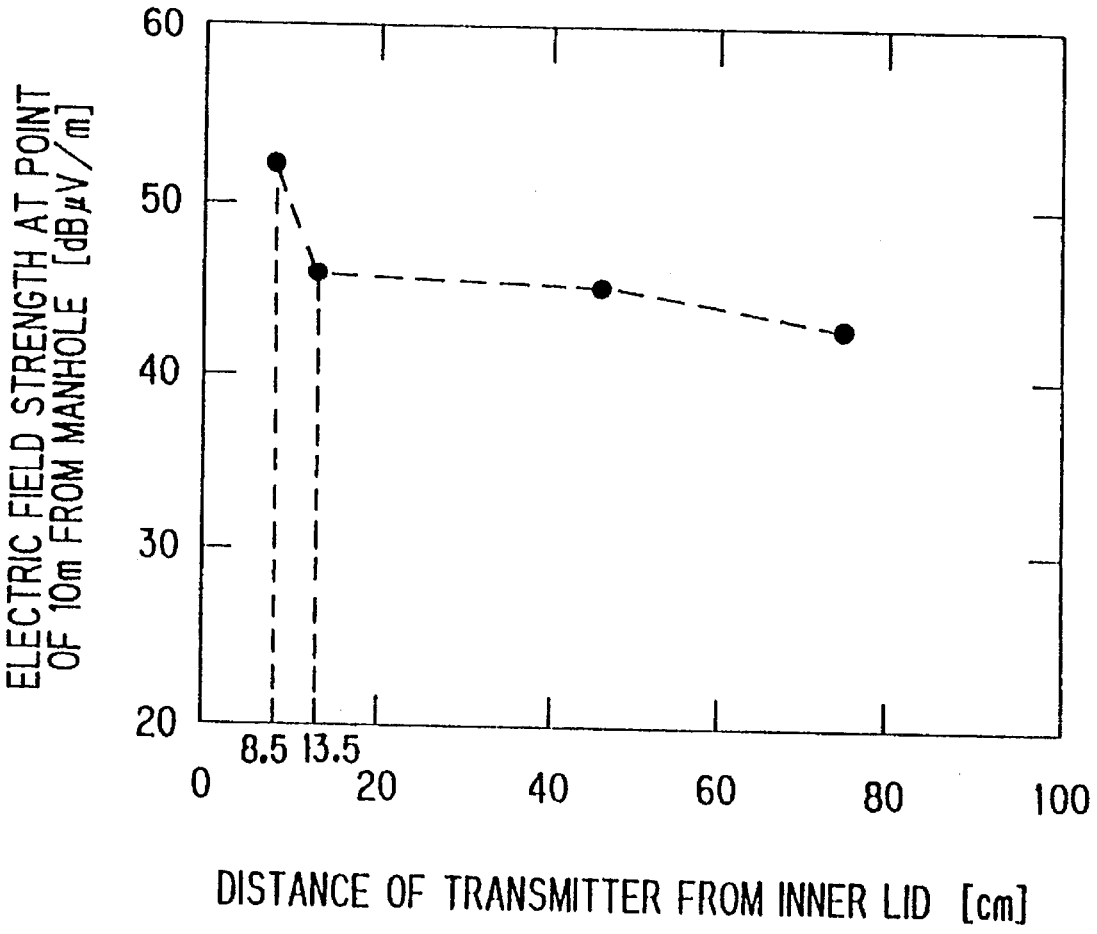
FIG. 7 is a graph showing electric field strengths at a distance of 10 m from a manhole, when the height of the transmitter is changed.

In this first experiment, the radio transmitter 8 is shifted from a dotted line position to a solid line position (the central position relative to the inner wall 1*b*) as shown in FIG. 6, and distances of the radio transmitter 8 relative to the inner lid 5 are set to be 9 cm and 4 cm. In this arrangement, an electric field strength is measured in accordance with a radio signal transmitted from the radio transmitter 8 by the receiver 100 positioned at a point 10*e* having a distance of 10 m from the central point of the opening 1*a* of the manhole 1.

The measured results are shown in the Table 1.

TABLE 1

| KIND OF APPARATUS | EXISTENCE OF OUTER LID 4 | DISTANCE BETWEEN INNER LID 5 AND TRANSMITTER 8 (cm) | FIELD STRENGTH (dBμV/m) | RELATION OF ANTENNAS 8 AND 61 |
|---|---|---|---|---|
| No. 3 | NO | 9 | 53 | — |
| No. 2 | NO | 9 | 49 | — |
| No. 1 | NO | 9 | 53 | PARALLEL |
| No. 1 | NO | 4 | 53–57 | PARALLEL |
| No. 1 | NO | 4 | 38–40 | NON-PARALLEL |
| No. 1 | YES | 4 | 47 | PARALLEL |

As clearly understood from the Table 1, a received electric field strength is increased as the distance between the radio transmitter 8 and the inner lid 5, that is, between the radio transmitter 8 and the receipt repeating or receiving antenna 61 becomes small, and when the antenna 8*a* of the radio transmitter 8 and the receipt repeating or receiving antenna 61 are parallel.

Actually, however, the radio transmitter 8 is preferable to be provided as near the inner wall 1*b* as possible, because an operator in operation is easier to pass through the opening 1*a* of the manhole 1.

2. The second experiment

As a result of the analysis in the first experiment, the second experiment is carried out, wherein electric field strengths of radio signals transmitted from the radio transmitter 8 are measured at points 10*a* to 10*i* positioned around the central point 10*e* and on sides of a square (2 m×2 m) by the receiver 100 positioned at the height of 1 m on ground as shown in FIG. 6, under condition where a distance of the radio transmitter 8 from the inner lid 5 is changed.

In the second experiment, it is found that the electric field strength is large in the vicinity of the point 10*e* having the distance of 10 m from the central point in the opening 1*a* of the manhole, when the radio transmitter 8 is located by a distance of less than 135 mm from the inner lid 5 under case where the radio transmitter 8 is installed near the inner wall 1*b* of the manhole as shown in FIG. 5.

As shown in FIG. 5, the inner lid 5 is supported on a hook of the support metal member 1*c* having a height h. If it is assumed that the height h is a practically required dimension of approximately 65 mm, it is difficult for the radio transmitter 8 to be proximate to the inner lid 5 by a distance of less than 75 mm, especially, in consideration of the configuration of the antenna 8*a*. When the radio transmitter 8 is more proximate to the inner lid 5, an electric wave radiated from the antenna 8*a* can not be directly received by the receiving antenna 61, because of the existence of the support metal member 1*c*. For this reason, it is preferable that a distance between the radio transmitter 8 and the inner lid 5 is set to be 75 to 135 mm.

As explained in the second preferred embodiment, the distance between the radio transmitter 8 and the inner lid 5 is set to be an optimum value, wherein the receipt and transmission repeating antennas 61 and 74 are matched in impedance to provide a radio signal of the maximum electric power by the impedance matching circuit 62 fixed in the inner lid 5, so that the radio signal transmitted from the radio transmitter 8 is effectively radiated from the interior of the manhole 1 to the exterior thereof even under case where the opening 1*a* of the manhole 1 is closed by the outer lid 4. Thus, the maintenance information of the manhole 1 is easily obtained on the outside of the manhole 1 without opening the outer and inner lids 4 and 5. Further, the transmission repeating antenna 74 is additionally provided below the outer lid 4, while it is not necessary for the outer lid 4 to function as an antenna, so that the electrical connection relative to the outer lid 4 is unnecessary to obviate any connecting trouble. Further, the receiving antenna 61, the impedance matching circuit 62 and the transmission repeating antenna 74 are mounted on the inner lid 5, an operator in operation does not have any obstacle in passing through the opening 1*a* of the manhole 1.

Finally, the advantages of the invention are summarized as follows.

(1) A transmission route is provided between an outer lid and a radio transmitter in a manhole, so that a radio signal is precisely supplied to the outer lid, even if there is a member to shield the radio signal in the manhole.

(2) Where an outer lid functions as an antenna, an electric field strength of a radio signal radiated from a manhole to the exterior thereof is largely improved to obviate the necessity for an operator in operation going down into the manhole for collection of maintenance information of the manhole.

(3) Where an impedance matching circuit fixed in a window of an inner lid is electrically connected to an outer lid, the existence of an inner lid does not obstruct any transmission of a radio signal.

(4) A repeating antenna(s) and an impedance matching circuit are mounted on an inner lid not to obstruct the opening and closing of the inner lid.

(5) Where an impedance matching circuit is electrically coupled to an outer lid by a spatial coupling capacitance, the electrical connection relative to the outer lid becomes easy and simple.

(6) Where an impedance matching circuit is electrically coupled to an outer lid by a conductive spring member, stable electric connection is obtained.

(7) Where a distance between a radio transmitter and the receiving antenna is set to be a distance of less than one wavelength of a radio signal, the receiving antenna receives the radio signal with an improved receiving strength.

(8) Where a length of the receiving antenna is a half wavelength of a radio signal, the receiving antenna receives the radio signal with an improved receiving strength.

(9) Where a radio signal is radiated below an outer lid, and the radiated radio signal is leaked through the outer lid, an electric field strength of the leaked radio signal on the outside of a manhole is largely improved to obviate the necessity for an operator in operation going down in a manhole for collection of maintenance information of the manhole.

(10) Where a radio signal is radiated below an outer lid by the transmission repeating antenna, no electrical connection relative to the outer lid is necessary.

(11) Where receipt and transmission repeating antennas are electrically connected on bottom and top surfaces of the inner lid, a radio signal is not shielded by the inner lid.

(12) A distance between a radio transmitter and a bottom surface of an inner lid is set to be 75 to 135 mm, so that a radio signal precisely reach receiving antenna to provide a predetermined electric field strength of the signal on the ground.

Although the invention has been described with respect to specific embodiments for complete and clear disclosure, the appended claims are not to be thus limited but are to be construed as embodying all modification and alternative constructions that may occur to one skilled in the art which fairly fall within the basic teaching herein set forth.

What is claimed is:

1. A method for monitoring equipment inside of a manhole, the method comprising the steps of:

collecting information about the equipment in said manhole;

transmitting said information to a radio transmitter, said radio transmitter being positioned in a vicinity of a bottom surface of an inner lid positioned in an opening of said manhole;

transmitting said information as a radio signal from said radio transmitter to a receiving antenna provided on said bottom surface of said inner lid;

coupling said information from said receiving antenna to an outer lid positioned in said opening of said manhole; and transmitting said information as a radio signal from said outer lid to an exterior of said manhole.

2. A method for monitoring equipment inside of a manhole, according to claim 1, wherein:

the step of coupling said information comprises the steps of:

supplying said information to an electrode provided on a top surface of said inner lid, said electrode being matched in impedance with said receiving antenna; and coupling said information from said electrode to said outer lid by a spatial capacitance.

3. A method for monitoring equipment inside of a manhole, according to claim 1, wherein:

the step of coupling said information comprises the step of:

supplying said information to a lead provided on a top surface of said inner lid, said lead resiliently contacting with said outer lid and being matched in impedance with said receiving antenna.

4. A method for monitoring equipment inside of a manhole, comprising the steps of:

collecting information about the equipment in said manhole;

transmitting said information to a radio transmitter, said radio transmitter being positioned in a vicinity of a bottom surface of an inner lid positioned in an opening of said manhole;

transmitting said information as a radio signal from said radio transmitter to a receiving antenna provided on said bottom surface of said inner lid;

supplying said information to a transmitting antenna provided on a top surface of said inner lid, said transmitting antenna being matched in impedance with said receiving antenna; and transmitting said information as a radio signal from said transmitting antenna to a space below an outer lid positioned in said opening of said manhole, said information being leaked through said outer lid to an exterior of said manhole.

5. An apparatus for monitoring equipment inside of a manhole, comprising:

a sensor for collecting information about the equipment in said manhole;

a signal processing circuit for processing said information to generate processed information;

a radio transmitter for transmitting said processed information, said radio transmitter being positioned in a vicinity of a bottom surface of an inner lid positioned in an opening of said manhole;

a receiving antenna for receiving said processed information transmitted from said radio transmitter, said receiving antenna being provided on said bottom surface of said inner lid;

means for coupling said processed information received from said receiving antenna to an outer lid positioned in said opening of said manhole, said means for coupling being provided on a top surface of said inner lid, and said processed information being transmitted as a radio signal from said outer lid to an exterior of said manhole.

6. An apparatus for monitoring equipment inside of a manhole, according to claim 5, wherein:

said coupling means is an electrode, said electrode being coupled to said outer lid by a spatial coupling capacitance and being connected to said receiving antenna by an impedance matching circuit.

7. An apparatus for monitoring equipment inside of a manhole, according to claim 5, wherein:

said coupling means is a lead, said lead being in contact resiliently with said outer lid and being connected to said receiving antenna by an impedance matching circuit.

8. An apparatus for monitoring equipment inside of a manhole, according to claim 5, wherein:

a length of said receiving antenna is half wavelength of said radio signal.

9. An apparatus for monitoring equipment inside of a manhole, according to claim 5, wherein:

a distance between said radio transmitter and said receiving antenna is less than one wavelength of said radio signal.

10. An apparatus for monitoring equipment inside of a manhole, according to claim 5, wherein:

a distance between said radio transmitter and said bottom surface of said inner lid is 75 to 135 mm.

11. An apparatus for monitoring equipment inside of a manhole, according to claim 6, wherein:

said impedance matching circuit is fixed in a window formed in said inner lid.

12. An apparatus for monitoring equipment inside of a manhole, comprising:

a sensor for collecting information about equipment in said manhole;

a signal processing circuit for processing said information to generate processed information;

a radio transmitter for transmitting said processed information, said radio transmitter being positioned in a vicinity of a bottom surface of an inner lid positioned in an opening of said manhole;

a receiving antenna for receiving said processed information transmitted from said radio transmitter, said receiving antenna being provided on said bottom surface of said inner lid; and a transmitting antenna for receiving said processed information and transmitting said processed information as a radio signal into a space below an outer lid positioned in said opening of said manhole, said transmitting antenna being provided on a top surface of said inner lid to be electrically connected with said receiving antenna, and said processed information being leaked through said outer lid to be radiated to an exterior of said manhole.

13. An apparatus for monitoring equipment inside of a manhole, according to claim 12, further comprising:

an impedance matching circuit for connecting said receiving antenna to said transmitting antenna, said impedance matching circuit being fixed in a window formed in said inner lead.

14. An apparatus for monitoring equipment inside of a manhole, according to claim 13, wherein;

a length of said receiving antenna is half wavelength of said radio signal.

15. An apparatus for monitoring equipment inside of a manhole, according to claim 13, wherein:

a distance between said radio transmitter and said receiving antenna is less than one wavelength of said radio signal.

16. An apparatus for monitoring equipment inside of a manhole, according to claim 13, wherein:

a distance between said radio transmitter and said bottom plane of said inner lid is 75 to 135 mm.

* * * * *